United States Patent [19]

Tabata

[11] 4,102,119

[45] Jul. 25, 1978

[54] ELECTRONIC TIMEPIECE

[75] Inventor: Junichi Tabata, Tokyo, Japan

[73] Assignee: Kabushiki Kaisha Daini Seikosha, Japan

[21] Appl. No.: 739,852

[22] Filed: Nov. 9, 1976

[30] Foreign Application Priority Data

Nov. 11, 1975 [JP] Japan ..... 50-135556
Nov. 11, 1975 [JP] Japan ..... 50-135560

[51] Int. Cl.[2] ..... G04C 3/00; G04B 37/00

[52] U.S. Cl. ..... 58/23 R; 58/50 R; 58/55; 58/88 R; 200/DIG. 1

[58] Field of Search ..... 58/23 R, 50 R, 55, 88 R, 58/152 R; 200/DIG. 1, DIG. 2

[56] References Cited

U.S. PATENT DOCUMENTS

| | | | |
|---|---|---|---|
| 3,482,241 | 12/1969 | Johnson | 340/365 C |
| 3,885,381 | 5/1975 | Kasai et al. | 58/23 BA |
| 3,937,004 | 2/1976 | Natori et al. | 58/50 R |
| 3,983,690 | 10/1976 | McClintock | 58/50 R |

FOREIGN PATENT DOCUMENTS

| | | | |
|---|---|---|---|
| 2,359,071 | 7/1974 | Fed. Rep. of Germany | 58/23 R |

*Primary Examiner*—Edith S. Jackmon
*Attorney, Agent, or Firm*—Robert E. Burns; Emmanuel J. Lobato; Bruce L. Adams

[57] ABSTRACT

A case-back of an electronic timepiece is provided with a means to detect whether said timepiece is on a human arm or not. When the timepiece is put on the arm, said detecting means operates a switching means to enable a display. When the timepiece is taken off the arm the display is not operated, so the consumption is reduced and the battery is saved.

3 Claims, 6 Drawing Figures

ELECTRONIC TIMEPIECE

BACKGROUND OF THE INVENTION

A switching means to control a display means has not been provided in a conventional electronic timepiece having a liquid crystal display means. The liquid crystal display means always operates even when it is not necessary to watch the display; for example at night when a man is sleeping. Then the timepiece battery is consumed uselessly.

But when a manual switch is employed to avoid the above mentioned disadvantage, it is very troublesome to push the switch to watch a display which is composed of light emitting diode. It has been desired to have a convenient switching means to operate the display only when it is necessary to watch the display.

SUMMARY OF THE INVENTION

This invention relates to an electronic timepiece, having a detecting means to control a switch which operates the display means. Said detecting means detects electric resistance or induced hum of the human body. When the timepiece is put on a human arm, said resistance or induced hum controls a switch to operate the display means. When the timepiece is taken off the human arm, the display means does not operate. So, useless battery consumption can be avoided.

DETAILED DESCRIPTION OF THE PREFERRED EMBODIMENTS

Figure 1:
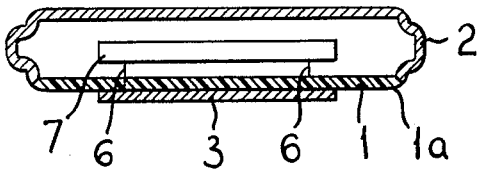
FIG. 1 is a cross-sectional view of the electronic timepiece according to the present invention showing its entire structure.

In FIG. 1, reference numeral 1 shows a case-back attached to the case body 2. On the surface 1a of this case-back 1, there is provided an electrode 3 which detects induced hum.

Figure 2:
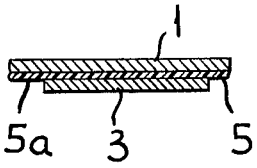
FIG. 2 is a partial cross-sectional view of another embodiment of the electrode mounting structure.

Said electrode 3 is fixed on the surface 1a directly when the case-back 1 is made of plastics, and is fixed on the surface 5a of an insulating member 5 which is placed on the surface 1a of the case-back 1 as shown in FIG. 2 when the case-back is made of metal. This electrode 3 is connected to the circuit block 7 which is provided in the case body 2 with a lead wire 6 penetrating the case-back 1.

Figure 3:
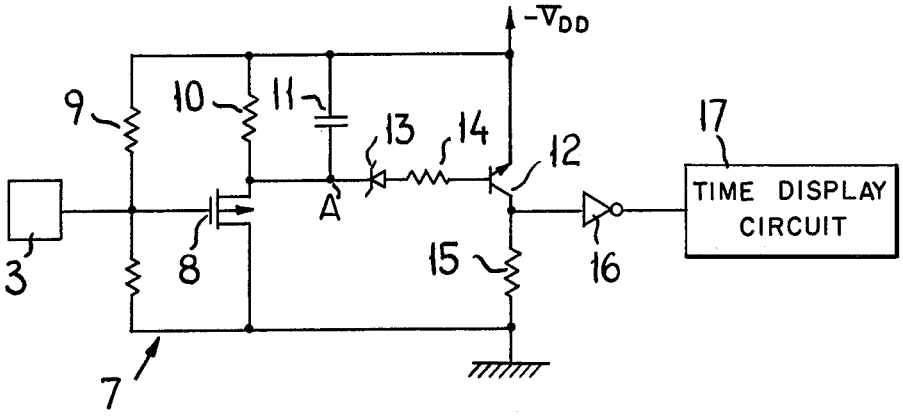
FIG. 3 is a circuit diagram showing a switching circuit.

FIG. 3 shows the circuit diagram of the switching circuit of the electronic timepiece according to the present invention. The reference numeral 8 is an FET MOS transistor, and the electrode 3 is connected to the gate of said transistor 8.

The gate and the drain of said transistor 8 are connected to the −VDD through the resistors 9 and 10 respectively. A condenser 11 is connected to the drain of the transistor 8 in parallel with said resistor 9. A zener diode 13 and a resistor 14 are connected in series between the drain of the transistor 8 and the base of the transistor 12. The emitter of said transistor 12 is connected to −VDD. The collector of said transistor 12 is connected to the earth through a resistor 15. An inverter 16 is connected between the output terminal of the collector of the said transistor 12 and the circuit 17 to display time.

The operation of the electronic timepiece which has the above described structure is as follows. When the timepiece is put on a human arm, the electrode 3 detects the induced hum which is generated in the human body. The detected signal which is a very low alternating current is transmitted to the gate of MOS transistor 8. A pulse signal is generated at the drain of MOS transistor 8 and charges the condenser 11. When the voltage at mode A in the FIG. 3 exceeds a threshold to make the zener diode 13 conductive, the next transistor 12 is made conductive, and the voltage of the output terminal of the collector is changed from earth to −VDD. At this time the voltage of the output of the inverter is changed from low level to high level, and the time display circuit works. The zener diode 10 defines a threshold which the signal induced in the electrode 3 must exceed for a certain period of time determined by the time constant of resistor 10 and condenser 11 before the transistor 12 is rendered conductive to develop an enabling signal for enabling the display 17.

Figure 4:
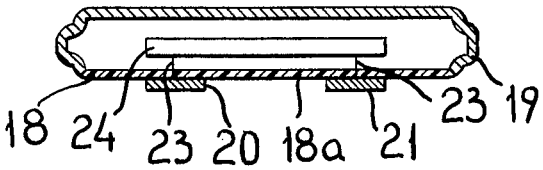
FIG. 4 is a cross-sectional view of another embodiment of the electronic timepiece according to the present invention showing its entire structure.
Figure 5:
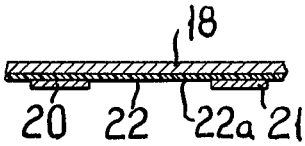
FIG. 5 is a partial cross-sectional view of another embodiment of the electrode mounting structure.
Figure 6:
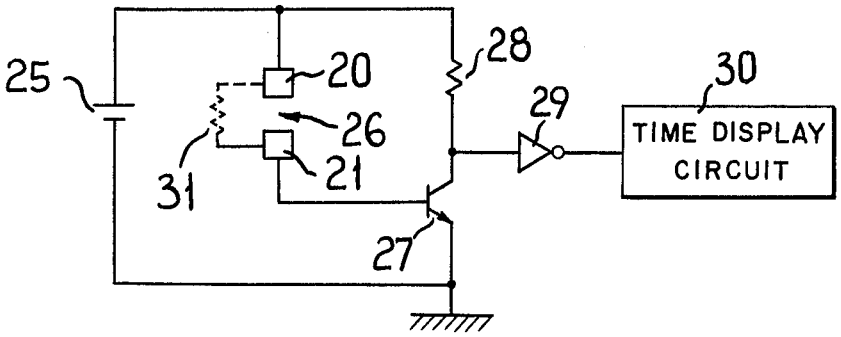
FIG. 6 is a circuit diagram showing another switching circuit.

In the FIGS. 4–6, the second embodiment of this invention is shown. In the FIG. 4, reference numeral 18 shows a case-back attached to the case body 19. On the surface **18*a* of this case-back 18, there are provided first and second electrodes 20 and 21** which are independent one another.

Said electrodes 20 and 21 are fixed on the surface **18*a* directly when the case-back 18 is made of plastics and are fixed on the surface 22*a* of an insulating member 22 which is placed on the surface 18*a* of the case-back 18 as shown in FIG. 5 when the case-back 18** is made of metal.

Each of the electrodes 20 and 21 are connected to the circuit block 24 which is provided in the case body 19 with a lead wire 23 penetrating the case-back 18.

FIG. 6 shows the circuit diagram of the switching circuit of the electronic timepiece according to this invention. The reference numeral 25 shows an electric power source. The reference numeral 26 is the detecting part consisting of electrodes 20 and 21. The electrode 20 is connected to the plus terminal of the power source 25. Another electrode 21 is connected to the base of the transistor 27 and the emitter of the transistor 27 is connected to the earth terminal. The collector of the transistor 27 is connected to the plus terminal of the power source 25 through the resistor 28 and is connected to the time display circuit 30 through the inverter 29.

Operation of the electronic timepiece which has the above described structure is as follows. When the timepiece is put on a human arm, each electrode 20 and 21 contacts the arm, and the base current of the transistor 27 flows through the arm represented by resistor 31, so the transistor 27 becomes conductive. The voltage of the collector of the transistor 27, that is an input signal of the inverter 29, changes from high level to low level, and the output signal of the inverter 29 changes from low level to high level making the time display circuit work and display the time.

In the electronic watch according to this invention having the above described structure and mode of operation, the display can be operated when the watch is put on the human arm. The display does not work when the watch is off the arm. Therefore the battery consumption is greatly decreased, and the battery life is extended.

However, this invention can be applied to the light emitting diode timepiece which displays all the time.

What is claimed is:

1. In an electronic timepiece: a display operative for displaying time in response to an electrical enabling signal applied thereto; a timepiece case housing said display, said timepiece case including a case back having an electrically insulative exterior portion; at least one electrode mounted on said electrically insulative exterior portion of said case back and positioned to inductively couple with an arm of a person wearing the electronic timepiece; and circuit means responsive to signals induced in said electrode from the arm of a person wearing the timepiece for developing an enabling signal and for applying said enabling signal to said display to enable said display when the timepiece is worn on the arm of a person.

2. In an electronic timepiece according to claim 1, wherein said circuit means includes means defining a threshold which the signal induced in said electrode must exceed for a certain period of time before said enabling signal is developed.

3. In an electronic timepiece according to claim 2, wherein said circuit means comprises a first transistor having a control electrode, means for applying a signal induced in said electrode to the control electrode of said first transistor, means for biasing said first transistor normally to a non-conductive state and to a conductive state when a signal induced in said electrode is applied to the control electrode of said first transistor, a resistor and a capacitor connected in parallel and connected to receive an output signal of said first transistor when the same is conductive to charge said capacitor, a second transistor having a control electrode, a zener diode connected to apply a voltage stored in said capacitor to the control electrode of said second transistor when the stored voltage exceeds the threshold value of said zener diode, and means for biasing said second transistor normally to a non-conductive state and to a conductive state to develop said enabling signal when the voltage stored in said capacitor is applied to the control electrode of said second transistor.

* * * * *